US005542758A

United States Patent [19]

Brown

[11] Patent Number: 5,542,758

[45] Date of Patent: Aug. 6, 1996

[54] ROTATABLE WARDROBE

[76] Inventor: Eliezer Brown, 800 Timber La., Dresher, Pa. 19025

[21] Appl. No.: 335,072

[22] Filed: Nov. 7, 1994

[51] Int. Cl.[6] ..... A47B 46/00; A47B 49/00; A47B 97/00

[52] U.S. Cl. ..... 312/249.2; 312/249.6; 211/1.3; 211/13; 211/99

[58] Field of Search ..... 312/249.2, 249.6, 312/313, 209, 248; 211/13, 96, 99, 100, 1.3

[56] References Cited

U.S. PATENT DOCUMENTS

| | | | |
|---|---|---|---|
| 138,279 | 4/1873 | Pert | 211/1.3 X |
| 185,384 | 12/1876 | Bisel | 312/249.6 |
| 241,123 | 5/1881 | Danner | 312/249.2 |
| 436,135 | 9/1890 | Hoffman | 312/249.2 X |
| 906,368 | 12/1908 | Barger | 312/249.2 |
| 2,379,975 | 7/1945 | Luger | 211/99 |
| 2,402,768 | 6/1946 | Murphy et al. | 211/99 |
| 3,411,633 | 11/1968 | Magnuson | 211/13 |
| 3,521,936 | 7/1970 | Coker | 312/209 |
| 3,704,790 | 12/1972 | Rock | 211/13 |
| 3,762,570 | 10/1973 | Tobin | 211/13 |
| 3,868,157 | 2/1975 | Robinson | 312/249.6 X |
| 3,938,667 | 1/1976 | Buckland | 211/13 X |
| 4,059,191 | 11/1977 | Chaisson | 211/13 X |
| 4,109,794 | 8/1978 | Samuel et al. | 211/13 |
| 4,239,311 | 12/1980 | Brownlee et al. | 312/249.2 X |
| 4,753,495 | 6/1988 | Swink | 312/249.2 X |
| 4,766,881 | 8/1988 | Pax | 312/248 X |
| 4,834,248 | 5/1989 | Lee | 211/13 |
| 5,312,181 | 5/1994 | Hudnall | 312/249.2 |
| 5,375,534 | 12/1994 | Adams | 211/1.3 X |

FOREIGN PATENT DOCUMENTS

| | | | |
|---|---|---|---|
| 252185 | of 1912 | Germany | 211/100 |

*Primary Examiner*—Peter M. Cuomo
*Assistant Examiner*—Rodney B. White
*Attorney, Agent, or Firm*—Zachary T. Wobensmith, III

[57] ABSTRACT

A combination wardrobe for storing trousers, shoes, shirts, belts and ties which is capable of presenting these items for access and storage, which is adjustable to accommodate different numbers and sizes of shoes, which occupies a small space, can be placed in a closet and is rotatable about a base for selective access to the items.

2 Claims, 1 Drawing Sheet

ROTATABLE WARDROBE

BACKGROUND OF THE INVENTION

1. Field of the Invention

This invention relates to a wardrobe of the type which stores various clothing items, shoes and ties on extensible racks, which is rotatable for selective access and can be placed in a closet.

2. Description of the Prior Art

It has long been recognized that it is desirable to be able to store a person's shoes and clothing items in a closet. Oftentimes, the available closets offer limited storage space, particularly when more than one person is using them. It is therefore desirable to more effectively utilize the available space. An appliance or piece of furniture is desirable which can fit into a limited closet space and which provides secure storage of the clothing items and easy access. Such furniture must effectively store the garments without wrinkling them, but provide the desired access. In addition, the furniture must be capable of storing a variety of sizes and shapes of shoes and boots with ready access to them.

Various solutions have been proposed for storage, such as that shown in the U.S. patents to J. F. Schmidt U.S. Pat. No. 353,382; J. A. Douglass et al. U.S. Pat. No. 786,737; S. O'Neal U.S. Pat. No. 1,219,854; W. V. Pittman U.S. Pat. No. 2,326,064; J. S. Zibell U.S. Pat. No. 2,608,457; Goldberg U.S. Pat. No. 4,219,248; W. D. Taylor U.S. Pat. No. 4,838,625; and R. W. Motley Sr. U.S. Pat. No. 5,118,176, but none of them provide the desired results.

The wardrobe of the invention does not suffer from the prior art problems and provides many positive advantages.

SUMMARY OF THE INVENTION

It has now been found that a wardrobe is available which permits the storage of a plurality of pairs of shoes and boots in a vertical structure, which has extensible racks carried thereon which support pants or trousers and shirts for storage or selection, with additional provisions for storing belts and ties therein, and which can be rotated to provide selective access to the stored items.

The principal object of the invention is to provide a wardrobe for storing clothing and other items which is of improved capacity and is easy to use.

A further object of the invention is to provide a wardrobe that is easily and economically manufactured.

A further object of the invention is to provide a wardrobe that safely stores trousers and other items on extensible racks.

A further object of the invention is to provide a wardrobe which is durable in service.

A further object of the invention is to provide a wardrobe which is selectively positionable to provide access to stored items as desired.

A further object of the invention is to provide a wardrobe that can be shipped in knock-down condition, and is easily assembled.

A further object of the invention is to provide a wardrobe which stores a plurality of shoes or boots on shelves in a vertically oriented case with provisions for varying the distance between the shelves.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof in which.

Figure 1:
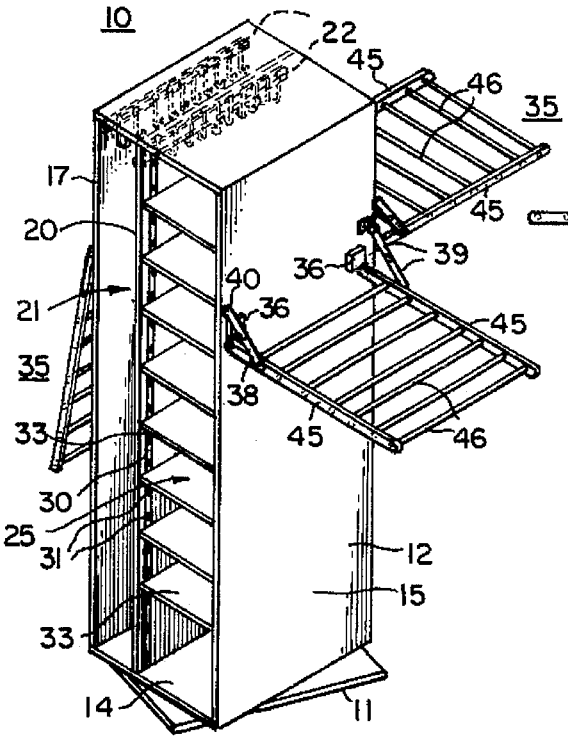
FIG. 1 is a view in perspective of the wardrobe of the invention.

It should, of course, be understood that the description and drawings herein are merely illustrative and that various modifications and changes can be made in the structure disclosed without departing from the spirit of the invention.

Like numbers refer to like parts throughout the several views.

DESCRIPTION OF THE PREFERRED EMBODIMENT

Referring now more particularly to the drawings, the wardrobe 10 is therein illustrated, which includes a base plate 11 of square shape and intended to be supported on the floor (not shown) of a closet (not shown). A vertical cabinet 12 is provided above base plate 11 and is mounted for rotation by a bearing assembly 13, which may be of conventional type, with a plate (not shown) on base 11 with grooves (not shown) which capture ball bearings (not shown) which bear up against an upper plate (not shown) mounted on a bottom plate 14 of cabinet 12 for rotation thereof.

The base plate 11 may be constructed of any suitable material, such as plywood.

The cabinet 12 includes the bottom plate 14, a right side panel 15 connected to the plate 14 and extending vertically, with a rear panel 16 connected to bottom plate 14 and to panel 15. A left side panel 17 is provided connected to base plate 14 and to rear panel 16. A top panel 18 is provided connected to right side panel 15, rear panel 16 and left side panel 17.

The cabinet 12 is open at the front, with a vertical divider panel 20 which extends across bottom plate 14, and is connected to rear panel 16 and top 18.

The panel 20 provides a storage area 21 which is suitable for storing shirts, dresses, belts and ties (not shown) with a pair of tie racks 22 therein fastened respectively to panel 20 and panel 17.

Divider panel 20 with right side panel 15 forms a space 25 suitable for storing shoes (not shown). The panels 20 and 15 are provided with two channel strips 30, each of which have a plurality of spaced openings 31, which receive clips 32 for supporting shelves 33. The shelves 33 are spaced vertically and adjustably to accommodate pairs of shoes or boots (not shown).

Figure 2:
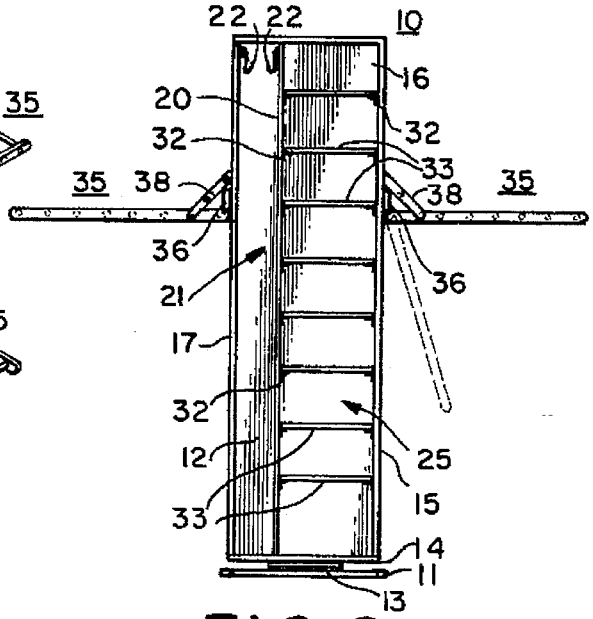
FIG. 2 is a front elevational view of the wardrobe of the invention illustrating positioning of the side extensible racks.
Figure 3:
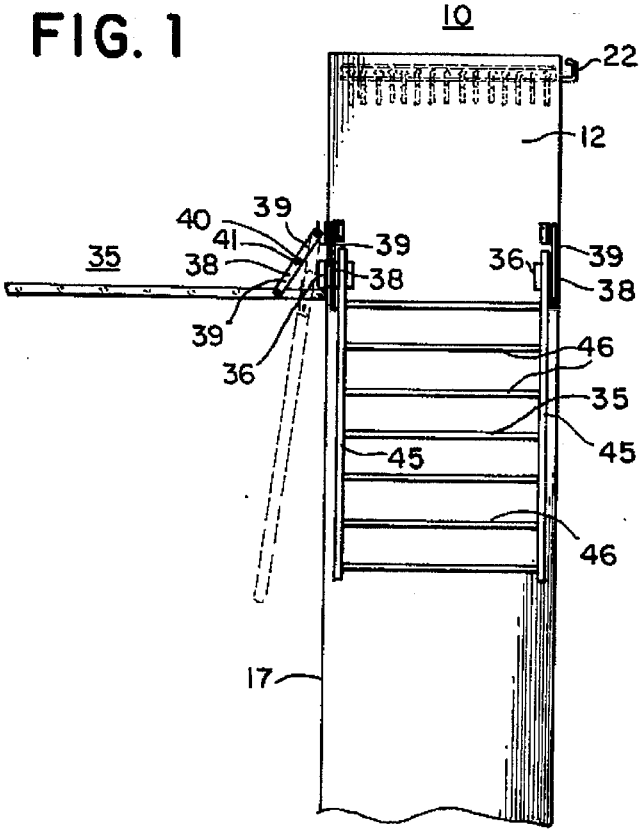
FIG. 3 is a left side fragmentary view of the wardrobe of the invention illustrating extensibility of the rear rack.

The panels 15, 16 and 17 have a rack 35 attached thereto by a pair of hinges 36. The rack 35 also has a pair of folding hinges 38 attached thereto and attached respectively to panels 15, 16 and 17 to support the rack in a horizontal position as shown in FIGS. 1 and 2, and to permit it to fold down as shown in phantom in FIG. 2. The hinges 38 are of well known type, which include two arms 39 pivotedly secured together by rivet 40, and with stops 41 to retain and permit the hinge 38 to fold and allow rack 35 to move down towards a vertical position as in FIG. 2.

The rack 35 may be constructed of any suitable material such as wood or metal and includes a pair of arms 45 with rods 46 connecting them. The rods 46 support the items of clothing such as trousers (not shown), and when the rack 35 is in extended position present the clothing items for placement and removal.

The placing of the racks 35 around the cabinet on panels 15, 16 and 17 in combination with bearing assembly 13 permits a greater number of clothings and other items to be stored and easily accessed.

It should be noted that the wardrobe can be shipped in knockdown condition and assembled on site.

It will thus be seen that structure has been provided with which the objects of the invention are achieved.

I claim:

1. A wardrobe for storing clothing and other items which comprises:

a base plate;

a bearing assembly mounted to said plate;

a cabinet mounted to said bearing assembly extending above said plate and rotatable therearound;

said cabinet having an open front, a bottom plate, right and left side panels, a rear panel and a top panel;

rack means hingedly secured to said side and rear panels;

folding hinge means attached to said side and rear panels and to said rack means to permit said racks to be selectively held in a horizontal position or rotated down to a storage position;

a vertically extending divider panel between said right and left side panels and extending to said rear panel to form first and second storage spaces;

belt and tie retaining means in said first storage space;

at least two pairs of channel strips mounted to said left side panel and to said divider panel;

a plurality of openings in said channel strips;

a plurality of clips selectively positionable in said openings; and a plurality of shelves supported by said clips to carry shoes and boots.

2. A wardrobe as defined in claim 1 in which said rack means is of rectangular shape with a pair of arms connected by a plurality of spaced rods to carry clothing.

* * * * *